US006647871B2

(12) United States Patent
Morand

(10) Patent No.: US 6,647,871 B2
(45) Date of Patent: Nov. 18, 2003

(54) LOADER FOR A PRINTER FOR PRINTING FLAT ARTICLES AND PRINTER PROVIDED WITH SUCH A LOADER

(75) Inventor: Nicolas Morand, La Varenne (FR)

(73) Assignee: ZIH Corp., Wilmington, DE (US)

( * ) Notice: Subject to any disclaimer, the term of this patent is extended or adjusted under 35 U.S.C. 154(b) by 57 days.

(21) Appl. No.: 10/022,441

(22) Filed: Dec. 20, 2001

(65) Prior Publication Data

US 2003/0116039 A1 Jun. 26, 2003

(51) Int. Cl.[7] ..... B41D 7/00; B41F 21/12; B41J 11/52; B65H 5/22

(52) U.S. Cl. ..... 101/33; 101/476; 101/485; 400/586; 400/594.1; 400/600.2; 400/601; 400/622; 400/624; 271/3.01; 271/3.08; 271/4.08

(58) Field of Search ..... 101/33, 476, 485; 400/586, 594.1, 600.2, 601, 622, 624; 271/3.01, 3.08, 4.08

(56) References Cited

U.S. PATENT DOCUMENTS 5,348,281 A * 9/1994 Yamada et al. ..... 271/3.1
6,135,591 A * 10/2000 Ikeda et al. ..... 347/104
6,206,367 B1 * 3/2001 Jo ..... 271/264

* cited by examiner

*Primary Examiner*—Andrew H. Hirshfeld
*Assistant Examiner*—Marvin P Crenshaw
(74) *Attorney, Agent, or Firm*—Young & Thompson

(57) ABSTRACT

A loader (1) for a printer for printing flat articles (2), this loader (1) which delimits a storage magazine (9) for the articles in the stacked condition being provided internally with a pivoting member (4) arranged to hold the articles (2) in bearing contact with a drive element (5) for discharging the articles (2) to be printed through an opening (7) provided in a wall of the magazine (1). This loader (1) is characterized in that the pivoting member (4) is provided with a counter-weight (6) to form an assembly exerting a substantially constant bearing force on the article or articles (2) to be printed, this forced being self-positioning in the course of emptying the loader by moving along one of the articles to be printed in a direction generally opposite to the direction of expulsion of the articles from the loader.

11 Claims, 6 Drawing Sheets

LOADER FOR A PRINTER FOR PRINTING FLAT ARTICLES AND PRINTER PROVIDED WITH SUCH A LOADER

The present invention relates to a loader for a printer for printing, preferably by thermal transfer, flat articles such as cards, in particular of plastic material, as well as a printer for printing, preferably by thermal transfer, provided with such a loader.

It relates more particularly to a loader for a printer of the type comprising, from upstream to downstream, a loader of articles to be printed adapted to coact with a drive element for ejecting articles from the loader, a printing device and transfer means to lead the articles sequentially from the outlet of the loader to the printing device and from the printing device to means for collecting printed articles. Such printers are well known to those skilled in this art.

BACKGROUND OF THE INVENTION

Until now, the expulsion of a card contained in a loader in the direction of the printer takes place as follows. The loader is constituted by a housing connected to one of the surfaces of the body of the printer. This housing comprises, in its bottom wall, an opening. The cards, stacked within the loader, are held bearing against the bottom of the housing by a weight positioned on the uppermost card in the stack. A cylinder projects partially through the opening and comes to bear against said cards. This cylinder is driven in rotation by a motor to effect by friction the expulsion of a card from the housing of the loader. This motor is stopped as soon as the card is left which is then driven to within the printer by transport rollers driven in rotation by means of a second motor. The printing device, disposed within the printer, is itself controlled in operation by means of a third motor.

The use of a weight, simply disposed on the top of the stack of cards, generates a certain number of drawbacks. Thus, in the course of microvibrations undergone by the stack of cards during expulsion of a card from the loader, there will be a movement of the weight on the upper surface of the stack of cards, such that the weight becomes rapidly ineffective. Moreover, as this weight is simply connected to the interior of the loader by the user after loading the loader with cards, it frequently happens that the user forgets to place the weight within the loader.

In another embodiment that is also known, the loader is provided with a pivoting flap disposed within the loader, this flap being returned to bear against the top of the pile of cards by return means generally constituted by a spring. This spring permits exerting a pressure force on the stack of cards to permit pressing the stack of cards against the output motor element for the articles to be printed in the printer. This solution again is not entirely satisfactory. Thus, when the loader is full, the spring is strongly compressed. There results an excessive application of force on the stack of cards, adapted to give rise to wedging of the cards or the expulsion of several cards at once. Conversely, when the loader is almost empty, the spring is in its extended position and exerts a small bearing force on the flap, generating insufficient coaction of the flap with the expulsion motor member for the cards of the loader. The drawback of such a device inherent in its design results from the fact that the force exerted on the stack of cards by the spring is a variable force. The absence of a constant force gives rise to the mentioned drawbacks.

SUMMARY OF THE INVENTION

An object of the present invention is to provide a loader for a printer for the printing, preferably by thermal transfer, of the mentioned type, whose design of the bearing means against the stack of cards permits exerting a constant bearing force independently of the height of the stack of articles contained in said loader.

Another object of the present invention is to provide a loader of the mentioned type whose design permits optimizing, in the course of emptying the loader, the positioning of the point of bearing as a function of the height of the stack of articles to be discharged from the loader.

To this end, the invention has for its object a loader for a printer that prints, preferably by thermal transfer, flat articles such as cards, in particular of plastic material, this loader, which delimits a storage magazine of the cards in the stacked position being provided internally with a pivoting member, such as a pivoting flap, arranged to maintain, in the active position of the loader, the articles to be printed in bearing contact against a drive element for discharging the articles to be printed by means of an opening provided in a wall of the magazine, characterized in that the pivoting member is provided with a counterweight to form an assembly exerting a substantially constant bearing force on the article or articles to be printed, independently of the height of the stack, this pressure positioning itself in the course of emptying the loader by moving along one of the articles to be printed in a direction generally opposite the direction of expulsion of the articles from the loader.

The design of the pressure means of the loader against the stack of articles constituted by a pivoting member provided with a counterweight, the assembly being secured to the magazine of the loader so as to generate a bearing point that is self-positioning in the course of emptying the loader, permits obtaining, on the one hand, the exertion of a constant bearing force on said stack of cards, on the other hand an optimization of the positioning of the bearing point in the course of emptying the loader.

There results in particular the possibility of obtaining, when the loader is almost empty, a positioning of the bearing point such that it generates no raising of the articles, which phenomenon is observed in particular when the bearing point is near the leading end of or the rear end of the articles to be expelled from the loader.

The invention also has for its object a printer for printing preferably by thermal transfer flat articles such as cards, in particular of plastic material, said printer being provided with a loader for articles to be printed, characterized in that the loader is of the mentioned type.

BRIEF DESCRIPTION OF THE DRAWINGS

The invention will be better understood from a reading of the following description of embodiments, with reference to the accompanying drawings, in which.

DETAILED DESCRIPTION OF INVENTION

As mentioned above, the loader 1, which is the object of the invention, is adapted to permit the loading of articles to be printed in a printer that prints preferably by thermal transfer. The objects to be printed are generally constituted by flat articles, such as cards, in particular of plastic material. This loader 1 delimits a magazine 9 for storage of the articles to be printed, these articles being stored in the form of a stack. According to the design of the printer, the loader 1 can be constituted by a member connected on one of the surfaces of the body 3 of the printer or can be present in the form of an assembly directly integrated with the body 3 of the printer. In this case, the loader is generally provided with a cover adapted to pass from an open position to a closed position and vice versa, to permit the introduction of articles to be printed within the loader. The design of a loader 1 in the form of a connected element offers a certain number of advantages. It permits particularly a partial overlapping of the loader with the printing head of the printer and renders possible the inclination of the loader 1.

Figure 5:
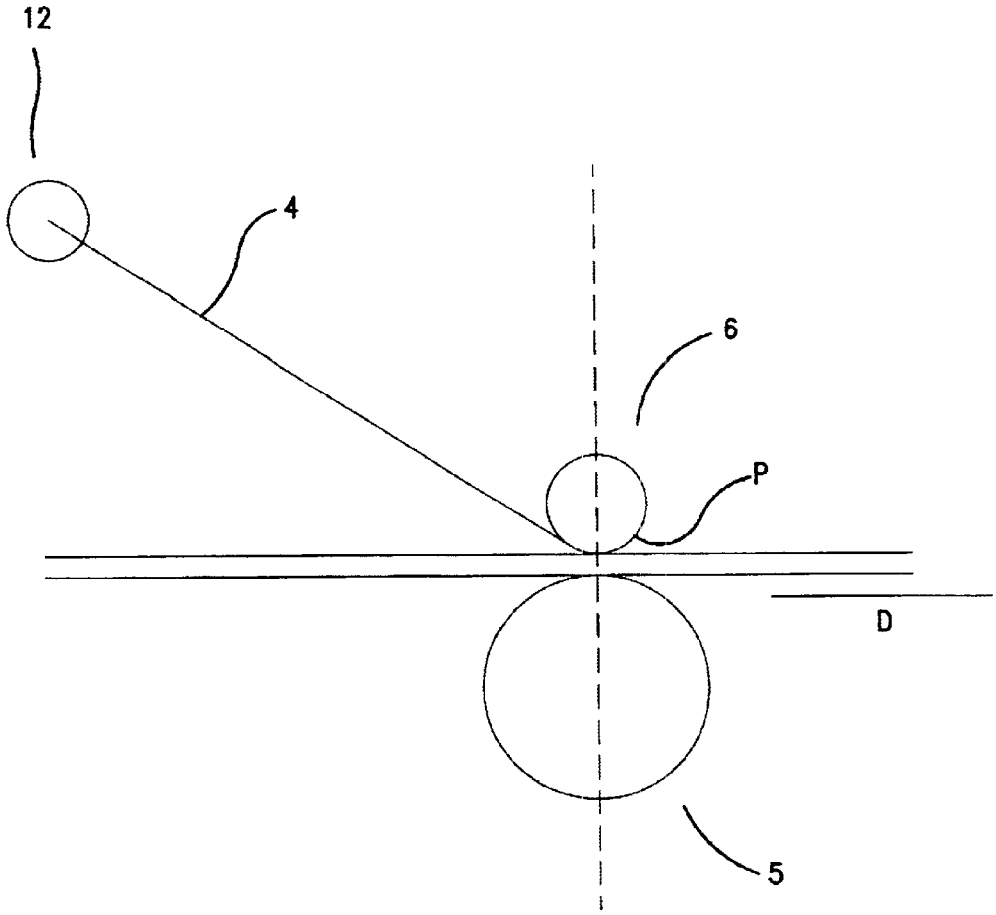
FIGS. 5 and 6 show schematically the positioning of the bearing point of the assembly of pivoting member— counterweight in the loaded condition of the loader in the case of FIG. 5 and in the substantially empty condition of the loader in the case of FIG. 6.
Figure 6:
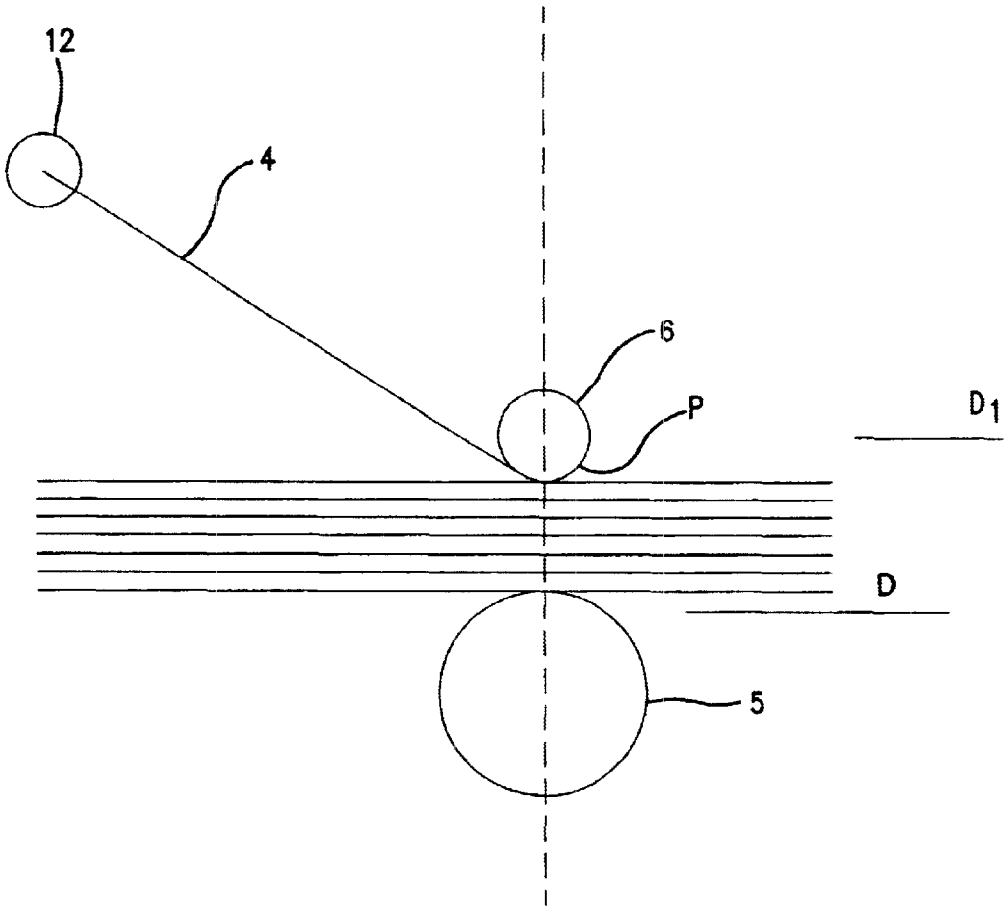

The storage magazine 9 of this loader is provided internally with a pivoting member 4 which, in the illustrated examples, is constituted by a pivoting flap 4, hollow or not in its central portion. This pivoting member 4 can have a large number of forms. In its simplest form, it will generally be constituted by a pivoting lever, but it can also take the form of an elbowed lever or two interconnected arms. This pivoting member 4 is arranged to maintain, in the active position of the loader 1, the articles 2 to be printed in bearing contact with the drive element 5 for expelling the articles 2 to the printer. This drive element 5 is generally constituted by a drive cylinder which projects at least partially within an opening 7 provided in a wall of the magazine 1, in this case the bottom wall of the magazine 1 in the illustrated examples. In a manner characteristic of the invention, the pivoting member 4 is provided with a counterweight 6 to form an assembly exerting a substantially constant force P on the article or articles 2 to be printed, this force being permanent in the course of emptying the loader 1. This force P is self-positioning, as shown in FIGS. 5 and 6, in the course of emptying the loader, by movement along one of the articles to be printed, in this case the article constituting the upper surface of the stack in a general direction D1 opposite to the direction D of expulsion of the articles from the loader, this direction D having been given by the direction of rotation of the cylinder or drive element 5. In other words, this bearing force P moves generally from the leading end toward the rear end of the article 2 against which this thrust is exerted in the course of emptying the loader.

To permit the evacuation of the articles 2, the magazine 9 for storing articles in the loader is provided with an expulsion slot 13 for the articles 2, this slot 13 being if desired provided with a strip 14. In the illustrated examples, the magazine 9 for storage of the articles is provided with a front opening 11 for loading the articles 2 within the loader. This magazine comprises, on its surface opposite to its introduction surface for the cards, at the base of said surface, the slot 13 for expulsion of the cards.

In a preferred embodiment of the invention, the counterweight 6 is a rotatable member turning about its own axis, such as a roller, so as to come into rolling bearing contact against the article or articles to be printed. This particular embodiment permits the counterweight to coact with the drive element 5 for expelling the articles 2 by taking part in the drive in particular of the last card from the loader, which is often the most difficult card to expel. Moreover, in this design of the counterweight, no returning or drive force is exerted at the surface of the stack of articles.

Figure 1:
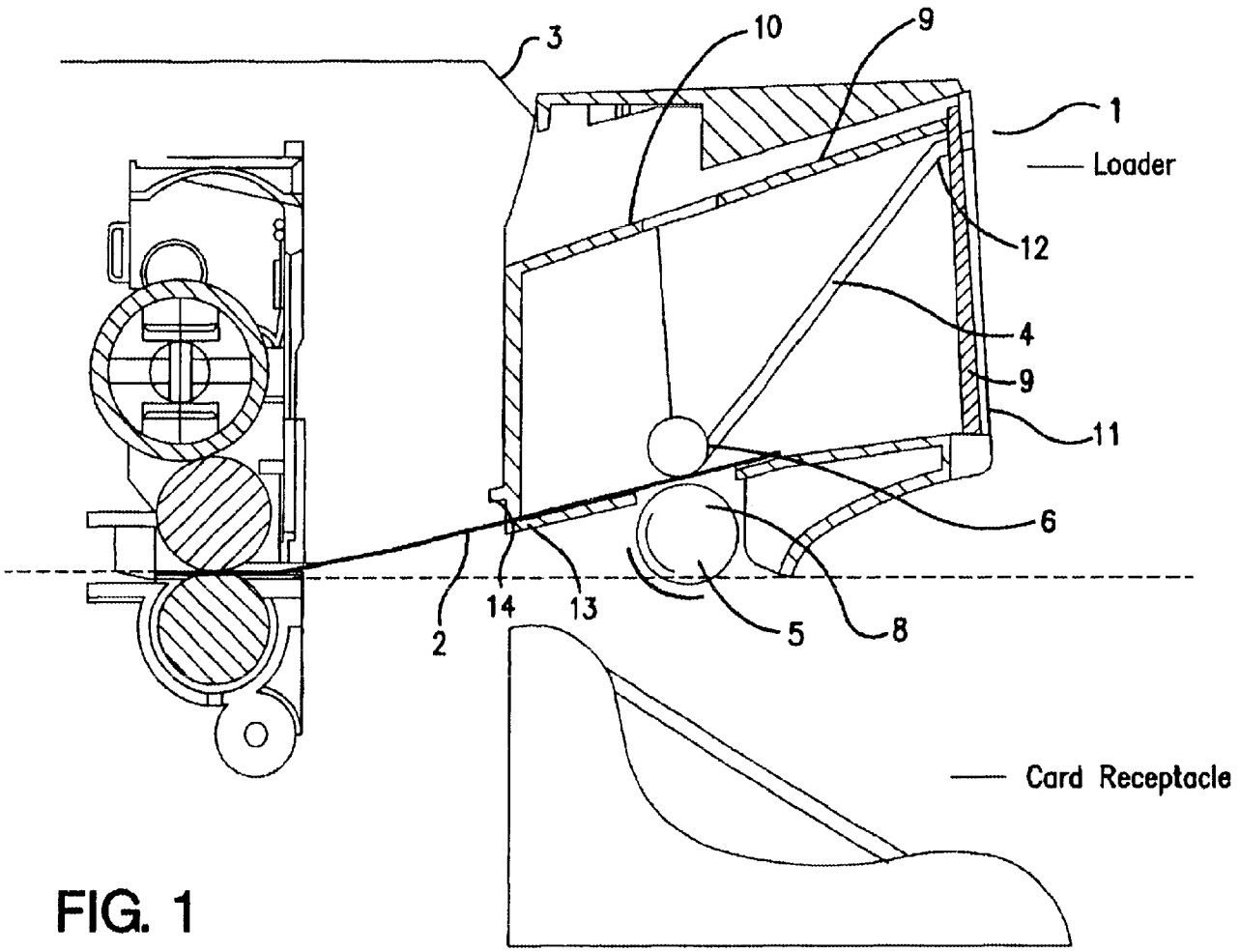
FIG. 1 is a cross-sectional view of a loader according to the invention in the active position corresponding to a position in which is it positioned on the body of the printer.
Figure 2:
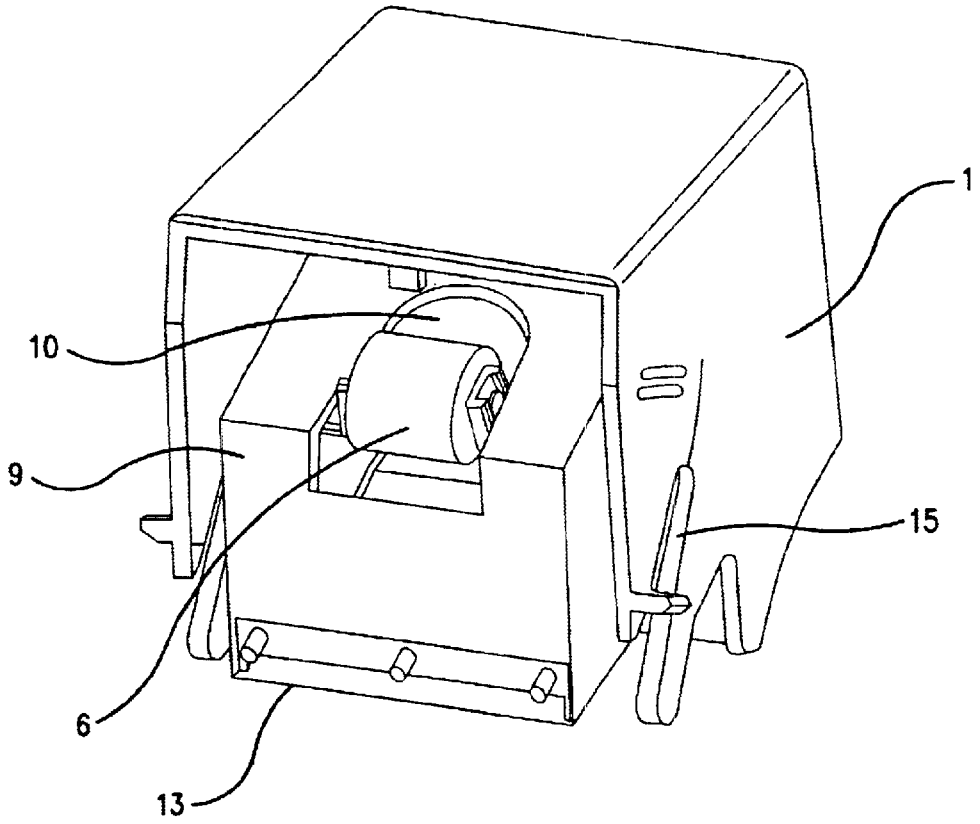
FIG. 2 is a perspective view of a loader taken from the side of the surface of the loader adapted to be applied against the body of the printer.
Figure 3:
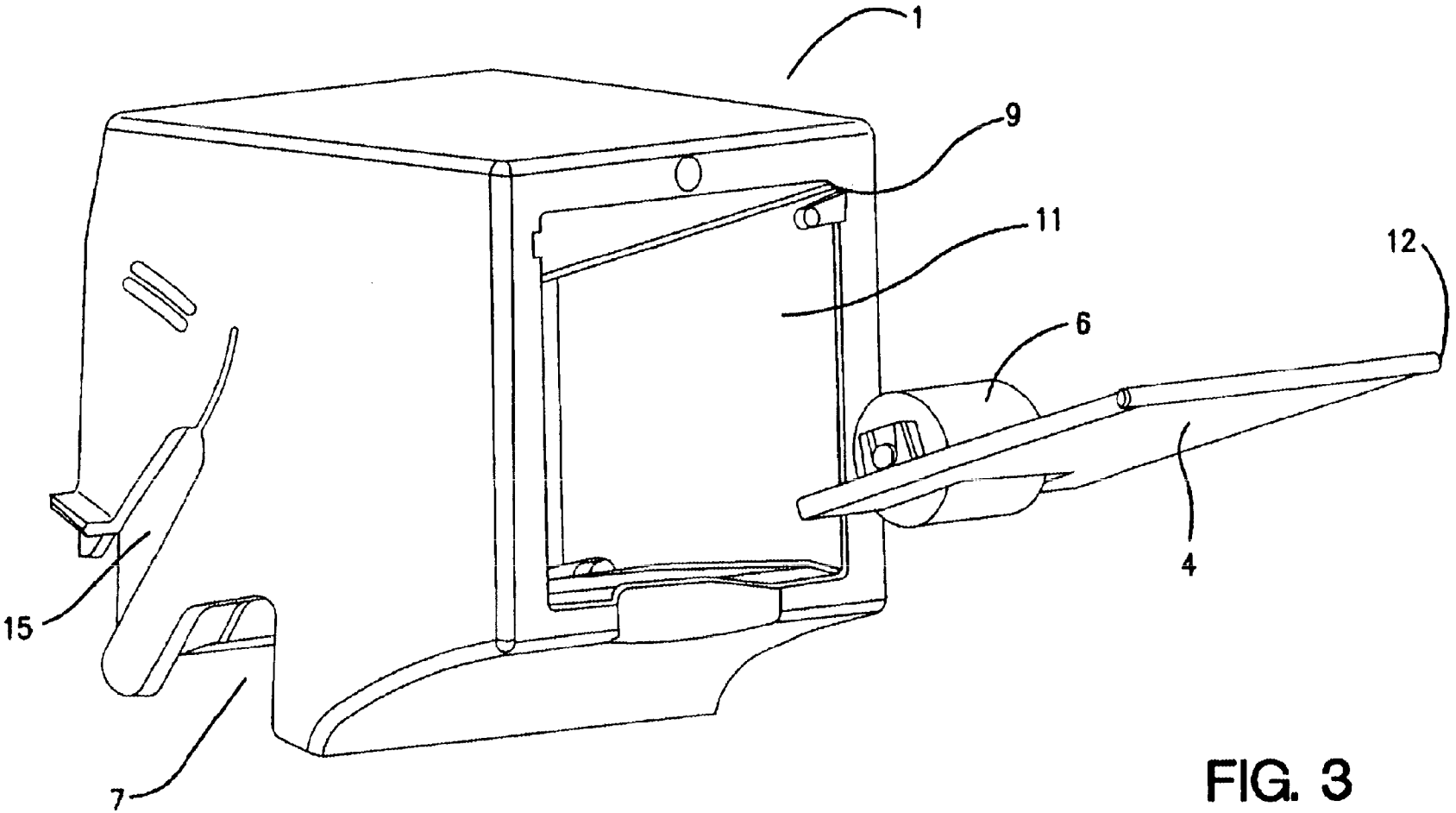
FIG. 3 is a rear perspective view of a loader, the pivoting member provided with its counterweight having been represented in the disassembled condition from the rest of the loader.
Figure 4:
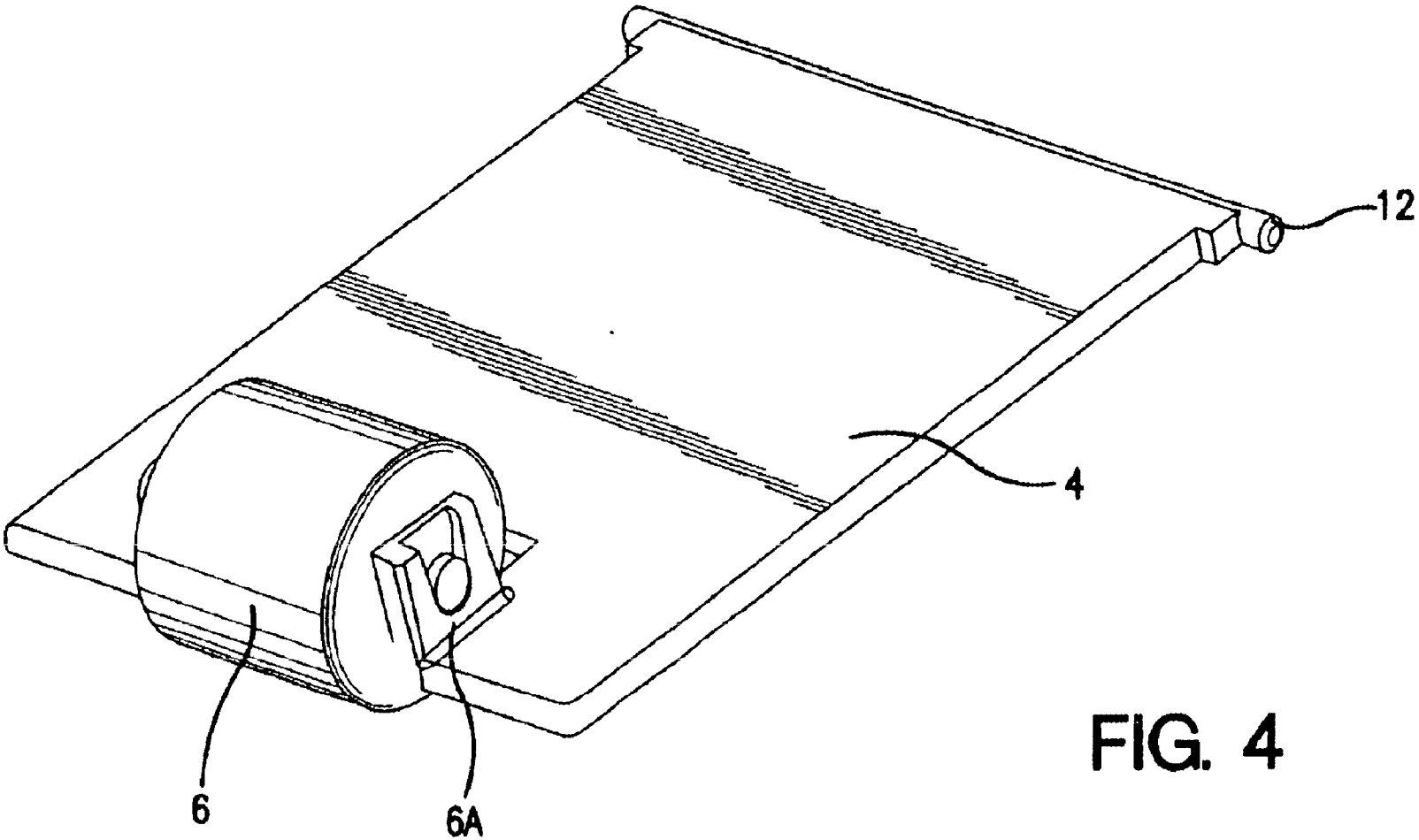
FIG. 4 is a perspective view of a pivoting member provided with a counterweight.

In this embodiment, counterweight 6 is disposed between two bearings 6A secured to the pivotal member 4 as shown in FIG. 4, these bearings 6A being positioned adjacent the free end of the pivoting member 4. Obviously, in another embodiment (not shown), this counterweight can be constituted by a simple mass fixed for example to the surface of said flap, the pressure P being thus constituted by the free end of said flap.

Independently of the embodiment chosen for the counterweight, this counterweight 6 is positioned on the pivoting member 4, preferably adjacent the free end of this latter, to pass, in the course of emptying the loader 1, generating an automatic movement of said pivoting member 4, from a position in which it extends, viewed in the direction of expulsion of the cards from the loader, upstream of the so-called active zone 8, of the opening 7 of the loader 1 corresponding to the contact zone between drive element 5 and article 2 to be printed, to an end of path position in which the counterweight 6 is positioned substantially at or near vertical alignment with the active zone 8 of the opening 7 of the loader 1. Again, this example is illustrated in FIGS. 5 and 6 in which has been shown by a broken line, the vertical alignment region with the drive element 5. It will be seen that, when the loader 1 is full, the counterweight 6 is positioned upstream of this line whilst being sufficiently spaced from the leading edge of the card so as not to generate a swinging of this card about the drive cylinder 5. Conversely, when the loader is nearly empty, the counterweight 6 will be positioned in vertical alignment with the drive element 5 to exert a force by means of a pressure P such that there is no swinging of the cards about the drive element 5, thereby to prevent any raising of the leading or trailing end of the article to be printed. Thus, this raising, when it is of the leading end of the card, prevents the expulsion of the card through the slot 13 provided for this purpose. Conversely, when the point B is disposed adjacent the leading end, it generates a raising of the rear end of the card and can prevent any positioning of the card in contact with the drive element 5 because of this raising. It is thus fundamental to optimize the positioning of the loading point P of the assembly formed by the pivoting member 4 and the counterweight 6 in the course of emptying the loader. This result is obtained from the assembly being formed by the pivoting member 4 and the counterweight 6, the positioning of the axis of articulation of the pivoting member 4, and the positioning of the counterweight 6 on this pivoting member. Thus, in the illustrated examples, the pivoting axis of the pivoting member 4 is positioned adjacent the summit of the opening 11 of the magazine 9. This positioning has, in addition to the advantages mentioned above, the possibility of disengaging completely the front opening 11 of the loader to facilitate the introduction of articles 2 to be printed within the loader 1. It is to be noted that, in these illustrated examples, the pivoting axis 12 is constituted by two lugs of the pivoting member 4 that come to rest in bearings provided in sidewalls of the magazine 9 of the loader 1.

The upper wall of the magazine 9 of the loader 1 is also provided with an opening 10 through which the counterweight 6 projects in the full condition of articles 2 to be printed in the loader 1, so as not to increase uselessly the size of this magazine.

In the illustrated examples, corresponding to a particular embodiment of the loader, the magazine 9 is disposed within a housing positioned or positionable on one of the surfaces of the body of the printer. In this case, the housing of the loader 1 comprises on its side surfaces in inclined slots 15 serving as rails for the positioning of the loader on the body of the printer.

What is claimed is:

1. Loader (1) for a printer for printing, on flat articles, the loader (1), which delimits a magazine (9) for storage of the articles in a stacked condition, being provided internally with a pivoting member (4), arranged to hold, in the active position of the loader (1), the articles (2) to be printed in bearing contact with a drive element (5), through an opening (7) provided in a wall of the magazine (8), for expulsion of the articles (2) to be printed characterized in that the pivoting member (4) is provided with a counterweight (6) to form an assembly exerting a substantially constant bearing force (P) on the article or articles (2) to be printed, this force (P) being self-positioning in the course of emptying the loader (1) by moving along one of the articles (2) to be printed in a direction (D1) generally opposite to the direction (D) of expulsion of the articles from the loader.

2. Loader (1) according to claim 1, characterized in that the counterweight (6) is a rotatable member turning about its own axis, so as to come into rolling bearing contact (P) on the article or articles (2) to be printed.

3. Loader (1) according to claim 2, characterized in that the counterweight (6) is disposed between two bearings (6A) secured to the pivoting member (4).

4. Loader (1) according to claim 1, characterized in that the counterweight (6) is positioned on the pivoting member (4), adjacent the free end of this latter, to pass, in the course of emptying the loader (1) generating an automatic movement of said pivoting member (4), from a position in which it extends, taken in the direction (D1) of expulsion of the articles (2) from the loader, upstream of an active zone (8), of the opening (7) of the loader (1) corresponding to the contact zone between the drive element (5) and the article (2) to be printed, to an end of path position in which the counter weight (60) is positioned substantially in or adjacent to vertical alignment with the active zone (8) of the opening (7) of the loader (1).

5. Loader (1) according to claim 1, characterized in that the opening (7), through which the drive element (5) of the printer comes into contact with the articles (2) to be printed, is provided in the bottom wall of the loader (1).

6. Loader (1) according to claim 1, characterized in that the magazine (9) for storing the articles is provided with a front opening (11) for loading the articles, the pivotable axle (12) of the pivoting member (4) being disposed adjacent the summit of this frontal opening (11) of the magazine (9).

7. Loader (1) according to claim 6, characterized in that the top wall of the magazine is provided with an opening (10) through which the counterweight (6) projects in the filled condition of the articles (2) to be printed in the loader (1).

8. Loader (1) according to claim 6, characterized in that the magazine (9) comprises, on its surface opposite its surface for introduction of the articles, at the base of said surface, a slot (13) for expulsion of the articles, this slot (13) being if desired provided with a strip (14).

9. Loader (1) according to claim 1, characterized in that the magazine (9) is disposed within a housing positioned or positionable on one of the surfaces of the body (3) of the printer.

10. Loader (1) according to claim 9, characterized in that the housing of the loader comprises on its side surfaces inclined slots (15) serving as a rail for the positioning of the loader on the body of the printer.

11. Printer for printing on flat articles, said printer being provided with a loader (1) for articles to be printed, characterized in that the loader (1) is according to claim 1.

* * * * *